United States Patent [19]

Trine et al.

[11] Patent Number: 4,486,619

[45] Date of Patent: Dec. 4, 1984

[54] UNIFORM TWISTED WIRE PAIR ELECTRICAL RIBBON CABLE

[75] Inventors: Richard D. Trine, Willernie; Lloyd S. Vasilakes, North St. Paul; Murray Olyphant Jr., Lake Elmo, all of Minn.

[73] Assignee: Minnesota Mining and Manufacturing Company, St. Paul, Minn.

[21] Appl. No.: 494,055

[22] Filed: May 12, 1983

[51] Int. Cl.[3] ..... H01B 11/04

[52] U.S. Cl. ..... 174/34; 174/117 F

[58] Field of Search ..... 174/32, 33, 34, 117 F

[56] References Cited

U.S. PATENT DOCUMENTS

| | | | |
|---|---|---|---|
| 1,475,139 | 11/1923 | Pearson . | |
| 3,459,878 | 8/1969 | Gressitt et al. . | |
| 3,579,823 | 5/1971 | Gressitt . | |
| 3,736,366 | 5/1973 | Wittenberg . | |
| 3,761,842 | 9/1973 | Gandrud . | |
| 3,838,715 | 10/1974 | Lang et al. . | |
| 4,012,577 | 3/1977 | Lang et al. . | |
| 4,034,148 | 7/1977 | Lang . | |
| 4,089,452 | 5/1978 | Houser et al. . | |
| 4,096,006 | 6/1978 | Paquin . | |
| 4,196,578 | 4/1980 | Vogelsberg . | |
| 4,202,722 | 5/1980 | Paquin . | |
| 4,233,807 | 11/1980 | Venable . | |
| 4,359,597 | 11/1982 | Paquin et al. | 174/34 |
| 4,381,426 | 4/1983 | Cronkite et al. | 174/34 X |
| 4,413,469 | 11/1983 | Paquin | 174/34 X |

FOREIGN PATENT DOCUMENTS

| | | | |
|---|---|---|---|
| 2523653 | 12/1976 | Fed. Rep. of Germany | 174/34 |

*Primary Examiner*—John Gonzales
*Assistant Examiner*—Morris H. Nimmo
*Attorney, Agent, or Firm*—Donald M. Sell; James A. Smith; William D. Bauer

[57] ABSTRACT

An electrical ribbon cable containing a plurality of longitudinally extending, individually insulated wire pairs being twisted together. An insulator is bonded to the plurality of wire pairs during only a portion of each individual twist of the wire pairs. The insulator holds the plurality of wire pairs in a fixed planar relationship. The wire pairs have a uniform twist period and have transversely aligned crossover points between wire pairs. The resultant cable combines the desirable electrical characteristics of a twisted pair cable with the desirable connectability characteristics of a parallel lay electrical ribbon cable.

14 Claims, 6 Drawing Figures

UNIFORM TWISTED WIRE PAIR ELECTRICAL RIBBON CABLE

BACKGROUND OF THE INVENTION

The present invention relates generally to electrical ribbon cables and more particularly to electrical ribbon cables having twisted wire pairs.

The advantages of flexible ribbon cable are well known in the field. One of the principal advantages of electrical ribbon cable is the ability to mass terminate the cable using standard insulation displacement connectors known in the industry as Mass Termination Insulation Displacement (MTID) connectors. A plurality of parallel wires are bonded with a common insulator in a planar arrangement. There is a known, fixed distance, usually a uniform distance, between each conductor. The common insulation usually conforms somewhat to the conductors on at least one side of the cable to allow for ease in locating the conductors during termination. It is very easy and quick to mass terminate such an electrical ribbon cable. The cable is flat and flexible so that it takes up a minimum of space and can be easily positioned where desired between electrical equipments. Another advantage is that a large number of conductors can be located in a small amount of space. A still further advantage is a much neater appearance than would result from the same number of separate conductors.

A problem with electrical ribbon cable is a limitation in the electrical characteristics provided. The electrical characteristics are dictated by the long parallel runs of closely spaced conductors. Typically, these electrical ribbon cables have rather poor crosstalk characteristics and rather poor magnetic field immunity.

Twisted pair electrical cable has long been known to possess much better electrical characteristics than parallel lay wires or cable. A pair of insulated conductors are typically twisted together along the length of the cable. The geometry of the twisted pairs is known to produce the desirable electrical characteristics of low crosstalk and high immunity from interference from external magnetic fields.

However, the fundamental disadvantage of twisted pair cable is the difficulty of termination. In general, each conductor has to be individually terminated.

One solution has been to make an electrical ribbon cable with twisted wire pairs formed into an insulator in a planar ("ribbon") relationship. Periodically, e.g. every 20 inches (50.8 centimeters), along the cable the twisted wire pairs are run for a straight parallel segment, e.g. 2 inches (5.08 centimeters) in length, to allow for mass termination. In particular, see U.S. Pat. No. 4,034,148, Lang, Twisted Pair Multi-Conductor Ribbon Cable With Intermittent Straight Sections and U.S. Pat. No. 4,202,722, Paquin, Apparatus For Making Twisted Pair Multi-Conductor Ribbon Cable With Intermittent Straight Sections. The cable described is the so-called "Twist'N'Flat" cable. However, the straight ("flat") sections have significantly compromised the electrical characteristics of the cable while the twisted sections have significantly compromised the connectability characteristics of the cable. To minimize the deleterious effect on the electrical characteristics of the straight sections, these straight sections are spaced farther apart. However, this increased spacing means that the cable can be mass terminated only at these spaced straight sections, often 20 inches (50.8 centimeters) apart.

A ribbon cable disclosed in U.S. Pat. No. 3,736,366, Wittenberg, Mass Bonding of Twisted Pair Cables, is a ribbon cable that has a plurality of wire pairs having twist rates that are multiples of one another. At periodic distances along the cable, the various angular locations of the varying twists match. The cable then can be mass terminated using a "knife" to sever the surrounding insulation in order to allow the cable to be pulled apart to "create" a section where the conductors are parallel for mass termination. A disadvantage of this cable is that a "knife", i.e. a separate tool, must be used to modify the cable (sever the insulation material bonding the twisted wire pair conductors together) so that it again can be modified (stretched) to enable mass termination. A further disadvantage is that this opportunity for modification only occurs periodically along the cable which period is a multiple of all of the varying twist lengths.

SUMMARY OF THE INVENTION

An electrical ribbon cable is provided which has a plurality of longitudinally extending, individually insulated wire pairs, with each of the plurality of wire pairs being twisted together. An insulator is bonded to the plurality of wire pairs during only a portion of each individual twist of the plurality of wire pairs, with the insulator holding the plurality of wire pairs in a fixed planar relationship. The plurality of wire pairs have a uniform twist period and have positions of the crossover points of corresponding ones of the plurality of wire pairs being transversely aligned along the electrical ribbon cable. A cable constructed in this manner has a plurality of wire pairs which may easily be mass terminated with standard electrical ribbon cable connecting equipment.

By keeping the twist period and the crossover points uniform among wire pairs, a known physical orientation of the conductors of the wire pairs is achieved.

By bonding the wire pairs to a single backing sheet, each wire in the wire pairs is physically restrained (bonded) to the backing sheet during only a portion of each twist. Each wire of the wire pairs is firmly bonded to the backing sheet when that wire is nearest the backing sheet, namely at alternating crossover points. Between crossover points, each wire is either not bonded or is loosely bonded to the backing sheet. Further in this region, each wire is relatively parallel to its pair. The combination provides the surprising result in that the wires are physically restrained sufficiently to be approximately correctly spaced for mass termination connectors and simultaneously sufficiently loosely attached to allow a certain degree of "float" or lateral movement of the wire to allow the connector to precisely "line up" the wire in order to complete the termination.

In a preferred embodiment, the angular velocity, in this case the rate of change in angular displacement along the longitudinal axis, of the wires during each twist is made nonuniform. At or near each crossover point the angular velocity is greater than average. Between crossover points the angular velocity is smaller than average. This creates an expanded "zone" between each crossover where the mass termination connector can be utilized.

BRIEF DESCRIPTION OF THE DRAWINGS

The foregoing advantages and construction of the present invention will become more readily apparent from the following description and accompanying drawings in which.

DETAILED DESCRIPTION OF THE PREFERRED EMBODIMENTS

Figure 1:
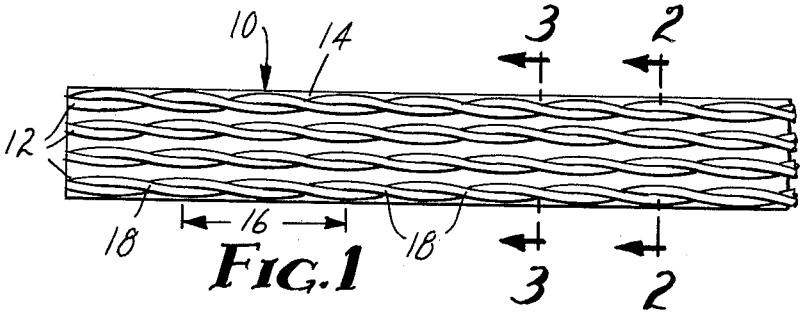
FIG. 1 is a plan view of an electrical ribbon cable according to the present invention.

FIG. 1 illustrates a plan view of an electrical ribbon cable 10 constructed according to the present invention. A plurality of wire pairs 12 are bonded to an insulator 14. In this embodiment, the insulator 14 is a single backing sheet. The wire pairs 12 of the cable 10 have a uniform twist period 16, or twist length, which is defined as one complete 360 degree twisting of a wire pair 12. The wire pairs 12 of the cable 10 also have crossover points 18, which is defined as the point along the cable 10 in which the wire pairs 12 have the individual wires crossing over one another and are directly orthogonal to the insulator 14, which are transversely aligned. Note that during one twist period 16 there are two crossover points 18.

A cable constructed as in FIG. 1 allows for mass termination near the area illustrated by section line 2—2 as each wire in the wire pairs 12 in this region of the cable 10 have their wires approximately parallel and either not bonded to the insulator 14 or loosely bonded to the insulator 14. This can be illustrated in FIG. 2 which is a cross-sectional view taken along section 2—2 of FIG. 1. Wire 20 and wire 22 of wire pair 12 lie side by side either not bonded to insulator 14 or loosely bonded to insulator 14. Wires 20 and 22 each contain a conductor 24 and 26, respectively, which is individually insulated. When a Mass Termination Insulated Displacement (MTID) connector is placed over the cable 10 at the position illustrated in FIG. 2, wires 20 and 22 of wire pair 12 are allowed to "float", that is to shift their lateral position, to accommodate the constraints of the MTID connector being applied thereto. The spacing from wire pair to wire pair should be the same as the center-to-center spacing of two connector positions on the MTID connector. The result is that wires 20 and 22 adapt to the spacing of the MTID connector and allow the twisted pair electrical ribbon cable 10 to be easily mass terminated while retaining all of the desired electrical characteristics of twisted pair cable.

Figure 3:
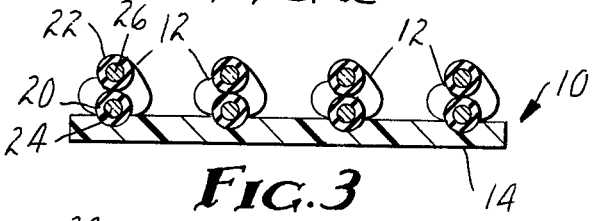
FIG. 3 is a cross-section view of the cable of FIG. 1 with the cross-section taken at a crossover point.

FIG. 3 is a cross-section of the cable 10 of FIG. 1 taken along section lines 3—3 at a crossover point 18 along the longitudinal length of the cable 10. Wire 20, nearest the insulator 14, is strongly bonded to the insulator 14 at this location. Wire 22, opposite wire 20 from insulator 14, is directly on top of wire 20 and is not bonded to insulator 14 at all. In an alternative embodiment, the insulation of wire 20 is bonded to the insulation of wire 22 at the crossover point 18.

Each conductor, e.g. 24 and 26, and each wire, e.g. 20 and 22, in each were in each wire pair adjacent each other 12 is individually insulated. The wires 20 and 22 are then twisted and the twist periods 16 or twist lengths are adjusted to be uniform among wire pairs 12. The twists are made transversely aligned among wire pairs 12 by controlling the crossover points 18 and insuring that the crossover points 18 remain transversely aligned. The plurality of wire pairs 12, so constrained, are then bonded to insulator 14, which may be a single backing sheet, to form the completed cable 10. In the preferred embodiment the bonding is accomplished by passing the twisted wire pairs 12 through nip rollers under heat to bond the insulation of wires 20 and 22 to insulator 14 under heat and pressure. In a preferred embodiment the insulation material surrounding conductors 24 and 26 of wires 20 and 22 is the same material as insulator 14.

Figure 2:
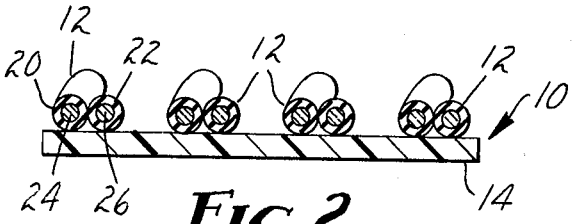
FIG. 2 is a cross-section view of the cable of FIG. 1 with the cross-section taken between crossover points.
Figure 4:
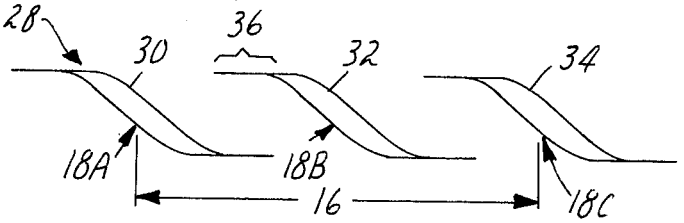
FIG. 4 is a diagramatic illustration of the bonding footprints of a typical wire pair of the cable of FIG. 1 but with opposite twist.

Constructing the cable in this manner but with opposite twist leaves a bonding footprint 28 as illustrated in FIG. 4. Wire 22 has crossed over wire 20 at crossover point 18A where wire 20 has been bonded to insulator 14 forming bonding footprint 30. Wire 20 then crosses on top of wire 22 at crossover point 18B where wire 22 is bonded to insulator 14 creating bonding footprint 32. The twist period 16 is completed at crossover point 18C where wire 20 again is bonded to insulator 14 and has created bonding footprint 34. The width of the bonding footprints 30, 32 and 34 diagramatically illustrate the strength of the bond as related to the width of the footprint. It can be seen that wire 20 is strongly bonded to insulator 14 at crossover points 18A and 18C and wire 22 is strongly bonded to the insulator 14 at crossover point 18B. However, between crossover points 18A and 18B, and similarly between 18B and 18C, there is a loosely bonded region 36 coinciding with the area in which the wires 20 and 22 of wire pairs 12 are side by side and approximately parallel, as illustrated in FIG. 2, where either wires 20 and 22 are not bonded to insulator 14 or are loosely bonded to insulator 14. This loose bond or lack of bond illustrates the construction in which the wires 20 and 22 are allowed to "float" to adapt to and conform to the Mass Termination Insulation Displacement (MTID) connector which can be utilized to mass terminate this twisted pair electrical ribbon cable 10.

Figure 5:
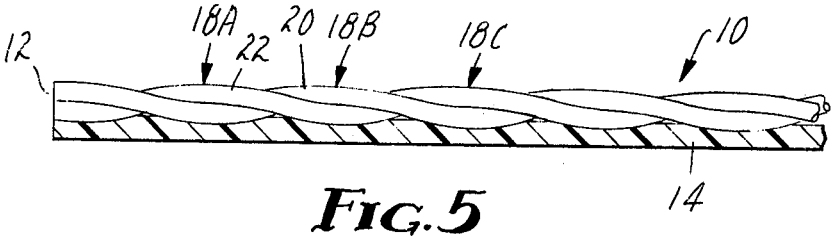
FIG. 5 is an edge view of the electrical ribbon cable of FIG. 1.

FIG. 5 additionally illustrates the bonding of the wire pairs 12 to the insulator 14. At crossover point 18A wire 20 is strongly bonded to the insulator 14 while wire 22 is completely free. This situation repeats itself at crossover point 18C. Similarly, at crossover point 18B wire 22 is strongly bonded to the insulator 14 and wire 20 is completely free. It can be seen that each of the wires 20 and 22 of the wire pair 12 is only partially bonded to the insulator 14.

The preferred material for the conductors 24 and 26 is copper, however, other good conductors could also be utilized as for example, aluminum. Stranded copper wire is preferred to aid in flexibility of the cable 10. The preferred wires for wires 20 and 22 of each wire pair 12 is 26 AWG to 30 AWG stranded copper wire twisted to form a wire pair 12 with from 0.040 inches (1.02 millimeters) to 0.034 inches (0.86 millimeters), respectively, between centers of the wires 20 and 22 of the wire pairs 12. The preferred spacing between wire pairs 12 is 100 mils (2.54 millimeters). This preferred spacing allows mass termination using standard insulation displacement connectors with 0.050 inch (1.27 millimeters) and 0.054 inch (1.37 millimeters) centers, namely SCOTCH-FLEX brand connectors manufactured by Minnesota Mining and Manufacturing Company, St. Paul, Minn. as represented by SCOTCHFLEX connector models 3399, 3406, 3482 and 3634.

The preferred material for the insulation of wires 20 and 22 and for the insulator 14 is polyvinylchloride. In addition, however, it is recognized that many other insulators are available in the marketplace and could be advantageously utilized with the subject cable 10. Some of these other insulators which could be utilized in the cable 10 are crosslinked polyethylene, polytetrafluoroethylene (PTFE), fluoronated ethylene propylene (FEP), ethylene tetrafluoroethylene, polyvinylidene fluoride, polyurethane, polyamide (nylon), and thermoplastic rubber.

The preferred means of bonding the wire pairs 12 to the insulator 14 is by heat and pressure adjusted to provide the desired degree of bonding. Alternatively an adhesive could be utilized to bond the wire pairs 12 to the insulator 14.

In selecting a twist period 16 for the wire pairs 12 of the cable 10 two competing constraints must be satisfied. In general, the shorter the twist period 16, the better the electrical characteristics of the cable 10 but the more difficult it is to connect the cable 10 with the MTID connectors. The longer the twist period 16, the easier it is to connect the cable 10 with the MTID connectors but the poorer are some of the electrical characteristics of the cable 10. Generally the range in twist period is from 2 twists per foot (30.48 centimeters) (4 crossovers) to 24 twists per foot (30.48 centimeters) (48 crossovers). This corresponds to twist lengths of from 6 inches (15.24 centimeters) to 0.5 inch (1.27 centimeters), respectively. It has been shown that a cable 10 with a twist period 16 in this range is satisfactory from both a connectability standpoint and an electrical characteristic standpoint.

The particular preferred twist period 16 of the cable 10 is 12 twists per foot (39.37 twists per meter) or a twist length of 1 inch (2.54 centimeters). It is preferred that the bonding between the wires 20 and 22 of a single wire pair 12 range from an underlap to a slight overlap as illustrated in the bonding footprints illustrated in FIG. 4. With the preferred twist period 16, this means that the preferred bonding lengths range from 0.4 inches (1.016 centimeters) to 0.8 inches (2.032 centimeters) and that a bonding length of each wire 20 or 22 within a wire pair 12 during each twist period 16 be between 0.6 inches (1.524 centimeters) to 0.8 inches (2.032 centimeters).

Throughout this specification the term uniform has been utilized to describe the twist period 16 of the cable 10 and the longitudinal position of the crossovers 18 of the cable 10 have been described as being aligned. It is to be recognized and understood that precise uniformity and exact longitudinal alignment between crossover points and exact uniformity in twist period 16 is probably not achievable by modern mass production processing equipment. For purposes of this specification, uniform and alignment are intended to mean uniformity to the extent that the resultant cable 10 can still provide the advantageous function described. With respect to the twist period 16, it is of little significance that the twist of the wires within one twist period are slightly in error. However, it is of great significance that the error not be allowed to accumulate over a significant length of cable 10. That is, the crossover points 18 must be maintained within a certain alignment to allow the cable 10 to function as described. Generally it has been found that if the crossover points 18 of the wire pairs 12 have an overall longitudinal tolerance of plus or minus 9.5 percent from their exact uniform longitudinal location, that the cable will still function as described.

Figure 6:
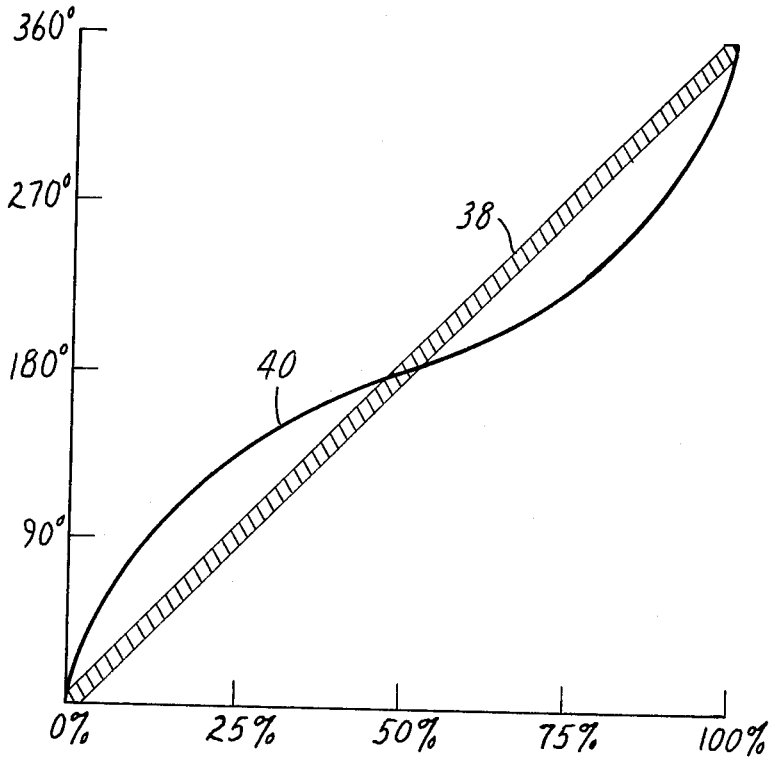
FIG. 6 is a graphical representation of nonuniform angular velocity.

In a preferred embodiment of the cable 10 the rotation of wires 20 and 22 within one twist period is not uniform. That is, the twist periods from their crossover points are uniform, however, the angular velocity (in this case the rate of change in angular displacement along the longitudinal axis) of each individual wire 20 and 22 within the twist period 16 between the crossover points 18 is not uniform. When two wires are twisted to form a twisted pair 12, the two wires form a regular helix. In a preferred embodiment of cable 10 the helix described by the twisted wires is not uniform. In particular, the angular velocity of the cables 20 and 22 is increased near the crossover points 18 and is decreased between the crossover points 18. This creates an angular velocity of the wires 20 and 22 at the crossover points which is higher than the average angular velocity of the wires 20 and 22 and creates an angular velocity between the crossover points 18 of a smaller than average of the angular velocity of the wires 20 and 22. The nonuniform angular velocity described above can be illustrated in reference to FIG. 6. FIG. 6 illustrates graphically the effect of uniform and nonuniform angular velocity. The abscissa represents the percentage of twist period or the longitudinal length along the cable 10 during one twist period 16. The ordinate represents the angular position of wires 20 and 22 with respect to each other, for example, with 0° and 360° representing wire 20 being positioned directly of top of wire 22, with 90° representing wire 20 being positioned directly to one side horizontally of wire 22, with 180° representing wire 20 being positioned at directly below wire 22 and with 270° representing wire 20 being positioned directly to the opposite side of wire 22 as its position at 90°. Line 38 generally represents wires 20 and 22 having a uniform angular velocity. Line 40 represents wires in 20 and 22 having a nonuniform angular velocity. The advantage in so altering the angular velocities is that the wires "crossover" more quickly and thus are available to lie in the approximate parallel position illustrated in FIG. 2 over a broader longitudinal range.

The cable 10 illustrated in FIG. 1 has all of the wire pairs 12 having a twist in the same direction, namely a right hand twist. It is to be recognized and understood that the cable 10 would function if, and it is within the scope of the present invention that, the wire pairs 12 would have a left hand twist. Further, it is contemplated that some of the wire pairs 12 have a left hand twist and some of the wire pairs 12 have a right hand twist. The connectability of the cable 10 is not appreciably affected.

While it is preferred that the term "pair" as in wire pair means two wires which can be twisted together, it is to be recognized and understood that it is within the scope of the present invention that the terms also include three or more wires which can be twisted together.

Thus, it can be seen that there has been shown and described a novel, uniform twisted wire pair electrical ribbon cable. It is to be understood, however, that various changes, modifications, and substitutions in the form of the details of the described cable can be made by those skilled in the art without departing from the scope of the invention as defined by the following claims.

What is claimed is:

1. An electrical ribbon cable, comprising:

a plurality of longitudinally extending, individually insulated wire pairs adjacent each other, each wire in each of said plurality of wire pairs being twisted together; and an insulator bonded to said plurality of wire pairs, said insulator for holding said plurality of wire pairs in a fixed planar relationship;

each wire of each one of said plurality of wire pairs being individually bonded to said insulator during only a portion of each individual twist;

said plurality of wire pairs having a uniform twist period and having positions of the crossover points of corresponding ones of said plurality of wire pairs being transversely aligned along said electrical ribbon cable;

whereby said plurality of wire pairs of said electrical ribbon cable may be easily mass terminated with electrical ribbon cable connecting equipment.

2. An electrical ribbon cable as in claim 1 wherein said portion in which each wire of each one of said plurality of wire pairs is bonded to said insulation is from 40 percent to 80 percent in length.

3. An electrical ribbon cable as in claim 1 wherein said insulator is a backing sheet and wherein each wire of each one of said plurality of wire pairs is bonded to said backing sheet with heat and pressure.

4. An electrical ribbon cable as in claim 3 wherein said plurality of wire pairs are insulated with polyvinylchloride and wherein said backing sheet is polyvinylchloride.

5. An electrical ribbon cable as in claim 2 wherein said twist period ranges from 0.50 inches (1.27 centimeters) to 6 inches (15.24 centimeters).

6. An electrical ribbon cable as in claim 5 wherein said twist period is one inch.

7. An electrical ribbon cable as in claim 6 wherein each of said plurality of wire pairs are bonded to said insulator for a distance of from 0.6 inches (1.524 centimeters) to 0.8 inches (2.032 centimeters) during each twist of each twist period.

8. An electrical ribbon cable as in claim 1 wherein each of said plurality of wire pairs has a nonuniform angular velocity during each twist of each twist period.

9. An electrical ribbon cable as in claim 8 wherein said portion in which each wire of each one of said plurality of wire pairs is bonded to said insulation is from 40 percent to 80 percent in length.

10. An electrical ribbon cable as in claim 8 wherein said insulator is a backing sheet and wherein each wire of each one of said plurality of wire pairs is bonded to said backing sheet with heat and pressure 11. An electrical ribbon cable as in claim 10 wherein said plurality of wire pairs are insulated with polyvinylchloride and wherein said backing sheet is polyvinylchloride.

12. An electrical ribbon cable as in claim 9 wherein said twist period ranges from 0.50 inches (1.27 centimeters) to 6 inches (15.24 centimeters).

13. An electrical ribbon cable as in claim 12 wherein said twist period is one inch.

14. An electrical ribbon cable as in claim 13 wherein each wire of said plurality of wire pairs are bonded to said insulator for a distance of from 0.6 inches (1.524 centimeters) to 0.8 inches (2.032 centimeters) during each twist of each twist period.

* * * * *